US005353463A

United States Patent [19]

Bracy, Jr.

[11] Patent Number: 5,353,463

[45] Date of Patent: Oct. 11, 1994

[54] BRUSH FOR CLEANING SINK DRAIN RECESSES AND THE LIKE

[76] Inventor: Bonnie C. Bracy, Jr., 1509 State St., Calumet City, Ill. 60409

[21] Appl. No.: 93,268

[22] Filed: Jul. 16, 1993

[51] Int. Cl.[5] ..... A46B 5/00; A46B 9/00

[52] U.S. Cl. ..... 15/160; 15/171; 15/143.1; D4/130; D4/133

[58] Field of Search ..... 15/160, 162, 164, 171, 15/179, 180, 143.1, 207.2; D4/111, 127, 128, 129, 130, 132, 133, 135, 138

[56] References Cited

U.S. PATENT DOCUMENTS

| | | | |
|---|---|---|---|
| D. 242,963 | 1/1977 | Glasberg | D4/128 |
| 1,405,938 | 2/1922 | Rasmesen | 15/186 |
| 1,977,746 | 10/1934 | Tolman | 51/209 |
| 2,210,094 | 8/1940 | Mueller | 15/23 |
| 2,250,112 | 7/1941 | Larson | 15/207.2 |
| 2,256,983 | 9/1941 | Lecker | 15/179 |
| 2,632,191 | 3/1953 | Grafani et al. | 15/164 |
| 2,728,929 | 1/1956 | Bell | 15/104.01 |
| 2,752,625 | 7/1956 | Ponsell | 15/209 |
| 2,755,494 | 7/1956 | Bredin | 15/143.1 |
| 3,100,311 | 8/1963 | Tutino | 15/209 |
| 3,355,759 | 12/1967 | Sloan | 15/206 |
| 4,120,068 | 10/1978 | Kaczmarek | 15/160 |
| 4,700,423 | 10/1987 | Zuliani | 15/160 |

FOREIGN PATENT DOCUMENTS

| | | | |
|---|---|---|---|
| 835291 | 3/1952 | Fed. Rep. of Germany | 15/160 |
| 588092 | 4/1925 | France | 15/160 |
| 25001 | of 1907 | United Kingdom | 15/162 |

*Primary Examiner*—Timothy F. Simone
*Assistant Examiner*—Gary K. Graham
*Attorney, Agent, or Firm*—McAndrews, Held & Malloy, Ltd.

[57] ABSTRACT

A brush for cleaning sink drain recesses comprises a truncated spheroidal base with side bristles extending radially from the convex side outer surface and bottom bristles extending perpendicularly from the planar bottom outer surface of the base. A handle extends perpendicularly from the top outer surface of the base with a grip portion at the top of the shaft portion of the handle. In operation, rotation of the handle about its longitudinal axis rotates the base and correspondingly rotates the side bristles and the bottom bristles against the adjacent surfaces of a sink drain recess, thereby abrading and scouring the adjacent surfaces to dislodge accumulated dirt, food substances and other particulate matter from the surfaces of the sink drain recess.

8 Claims, 1 Drawing Sheet

BRUSH FOR CLEANING SINK DRAIN RECESSES AND THE LIKE

FIELD OF THE INVENTION

The present invention relates to brushes. More particularly, the present invention relates to a brush particularly adapted to the cleaning of sink drain and disposal recesses.

BACKGROUND OF THE INVENTION

Many types of brushes are known that are capable of cleaning a wide variety of surfaces. None of these known brushes, however, is particularly suited to cleaning the shallow, round surface of a sink drain or disposal recess. Brushes designed for cleaning planar surfaces are inherently incapable of scouring the combination of geometrical surfaces present in a sink drain or disposal recess.

The sink drain or disposal recess is the site of a great deal of solid material build-up. These solid matters often consist of discarded food waste. As a result there is enhanced potential for harmful bacteria growth if this area is not cleaned thoroughly and regularly.

Accordingly, it is an object of the present invention to provide a brush designed for cleaning sink drain and disposal recesses.

It is also an object of the invention to provide a brush designed for cleaning sink drain and disposal recesses that is also capable of use as a multi-purpose brush, such as for cleaning cavities formed by the junction of a substantially planar surface with a substantially convex wall, as, for example, the bottom of a drinking glass.

SUMMARY OF THE INVENTION

The above and other objects are achieved by a brush for abrading the surface of a cylindrical recess having a concave bottom surface. The brush comprises:

a base having a truncated substantially spheroidal outer surface, the base comprising a top outer surface, a substantially planar bottom outer surface, and a substantially convex side outer surface interconnecting the top outer surface and the bottom outer surface;

a plurality of side bristles extending substantially radially from the side outer surface of the base;

a plurality of bottom bristles extending substantially perpendicularly from the bottom outer surface of the base; and a handle extending substantially perpendicularly from the top outer surface of the base member. Rotation of the handle about its longitudinal axis rotates the base member about an axis extending through the centroid of the base member and correspondingly rotates the side bristles and the bottom bristles.

The top outer surface of the base is preferably substantially planar. The top outer surface of the base can also be substantially convex. The handle can also be formed integrally with the base. The side bristles and the bottom bristles can also be formed integrally with the base. The side bristle, the bottom bristles, and the handle member are preferably formed integrally with the base member. The side bristles and the bottom bristles are preferably formed of metal. The handle preferably comprises a shaft portion extending from the base and a grip portion extending from the shaft portion at the end opposite the base. The grip portion preferably has at least one recess formed therein to facilitate the gripping of the brush.

The shape of the brush allows the user to thoroughly clean the sink recess by holding the brush by the handle and simultaneously twisting the brush while applying downward pressure into the sink recess. The twisting motion will apply pressure to the bristles radiating from the convex sides of the base member while the downward motion will apply pressure to the bristles radiating from the bottom of the base member. These forces will cause the bristles to abrade the recess surface, resulting in the desired cleaning action.

DETAILED DESCRIPTION OF THE PREFERRED EMBODIMENT

Figure 1:
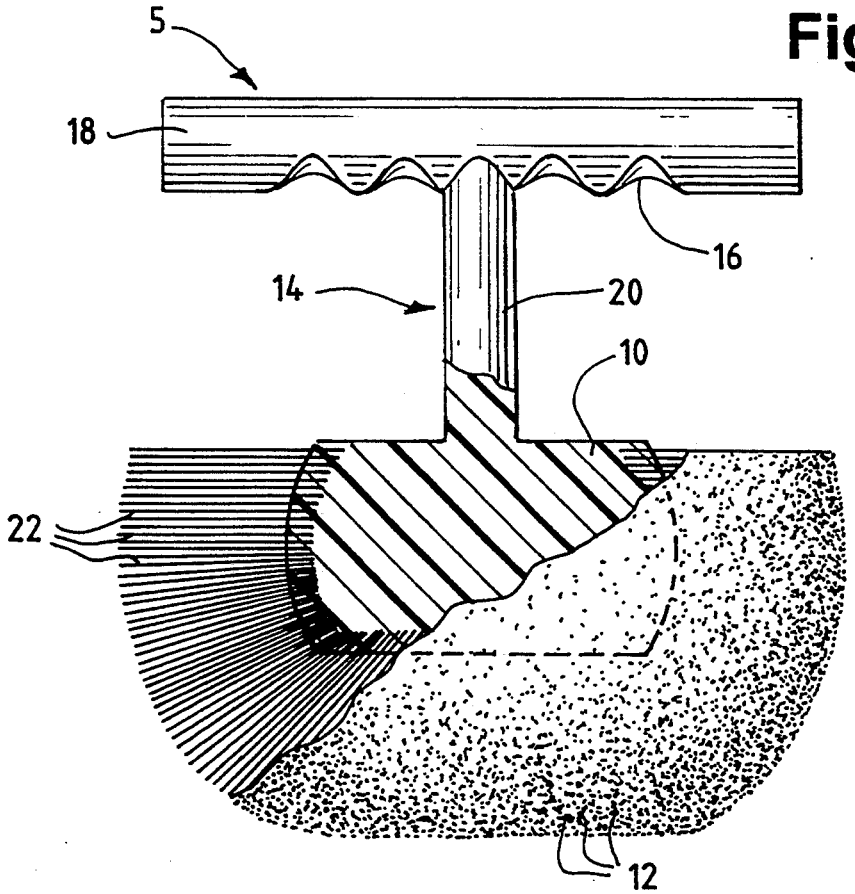
FIG. 1 is a side elevation view of a brush in accordance with one embodiment of the present invention, illustrating the base member having a truncated spheroidal outer surface with radially extending bristles.

Turning first to FIG. 1 of the drawings, brush 5 is shown in front elevation view. Brush 5 comprises a base 10 having a truncated spheroidal outer surface. The bottom of base 10 is substantially planar, and has a plurality of bristles 12 extending perpendicularly therefrom, as shown in FIG. 1. The convex side surface of base 10 has a plurality of bristles 22 extending radially therefrom.

FIG. 1 further shows a handle 14 comprising a shaft portion 20 extending perpendicularly from the top planar surface of base 10 and a grip portion 18. Shaft portion 14 is preferably integrally formed or molded with grip portion 18. Most preferably, grip portion 18 has finger recesses 16 formed therein to accommodate and provide means for firmly gripping grip portion 18.

Figure 2:
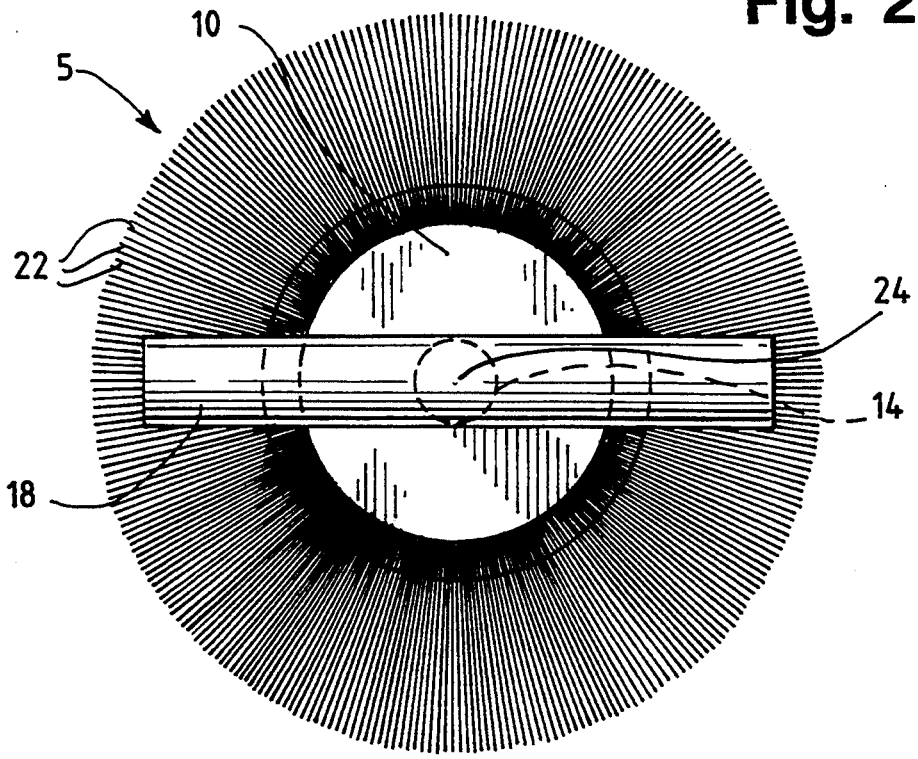
FIG. 2 is a top view, partly in section, of the brush illustrated in FIG. 1.

FIG. 2 shows a top view of the components of brush 5. Bristles 22, illustrated partially by phantom lines in FIG. 2, extend substantially radially from the convex side surface of base 10.

In operation, rotation of the handle 14 about its major axis rotates base 10 about its axis extending through the centroid 24 of base 10, and correspondingly rotates side bristles 22 and bottom bristles 12 against the adjacent surfaces (not shown in FIGS. 1 and 2) of a sink drain recess, thereby abrading and scouring the adjacent surfaces to dislodge accumulated dirt, food substances and other particulate matter from the surface of the sink drain recess.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A brush for abrading the surface of a cylindrical recess having a concave bottom surface, said brush comprising:

a truncated spheroidal base, said base comprising a top outer surface, a substantially planar bottom outer surface, and a substantially convex side outer surface interconnecting said top outer surface and said bottom outer surface;

a plurality of side bristles extending substantially radially from said side outer surface of said base;

a plurality of bottom bristles extending substantially perpendicularly from said bottom outer surface of said base; and a handle extending substantially perpendicularly from said top outer surface of said base;

whereby rotation of said handle about its longitudinal axis rotates said base about an axis extending through the centroid of said base and correspondingly rotates said side bristles and said bottom bristles.

2. The brush of claim 1 wherein the top outer surface of said base is substantially planar.

3. The brush of claim 1 wherein said handle is formed integrally with said base.

4. The brush of claim 1 wherein said side bristles and said bottom bristles are formed integrally with said base.

5. The brush of claim 1 wherein said side bristle, said bottom bristles, and said handle member are formed integrally with said base member.

6. The brush of claim 1 wherein said side bristles and said bottom bristles are formed of metal.

7. The brush of claim 1 wherein said handle comprises a longitudinal shaft portion, said shaft portion having two opposite ends, one of said ends extending from said base, and a grip portion extending from the other end of said shaft portion.

8. The brush of claim 7 wherein said grip portion has at least one recess formed therein to facilitate the gripping of said brush.

* * * * *